United States Patent [19]

Buckwalter et al.

[11] 4,111,646

[45] Sep. 5, 1978

[54] METHOD OF NO-CONTACT PRINTING OF CARPET WITH A TRANSFER SHEET

[75] Inventors: Mervin R. Buckwalter; Walter T. Bulson, both of Lancaster; Larry W. Leininger, Akron; Thomas Posipanko; Leonard N. Ray, Jr., both of Lancaster, all of Pa.

[73] Assignee: Armstrong Cork Company, Lancaster, Pa.

[21] Appl. No.: 761,604

[22] Filed: Jan. 24, 1977

[51] Int. Cl.[2] ..... D06P 5/20

[52] U.S. Cl. ..... 8/2.5 A; 28/159; 101/470

[58] Field of Search ..... 101/470; 8/25 A; 28/159

[56] References Cited

U.S. PATENT DOCUMENTS

| | | | |
|---|---|---|---|
| 1,668,322 | 5/1928 | Kessler | 101/152 |
| 1,957,937 | 5/1934 | Campbell et al. | 68/5 D |
| 2,049,495 | 8/1936 | Freuder | 101/119 |
| 2,590,850 | 4/1952 | Dungler | 68/5 D |
| 2,792,780 | 5/1957 | Jacob | 101/119 |
| 3,303,575 | 2/1967 | Gistren | 34/115 |
| 3,458,335 | 7/1969 | Newman | 428/195 |
| 3,655,379 | 4/1972 | Gundlach | 96/27 |
| 3,949,574 | 4/1976 | Glover | 101/470 |
| 4,007,003 | 2/1977 | Bulson | 101/470 |

*Primary Examiner*—Clyde I. Coughenour

[57] ABSTRACT

A transfer sheet is printed with inks containing sublimable dyes. A carpet having face fibers and a backing is prepared. The inked surface of the transfer sheet and the carpet are positioned adjacent the openings on opposite sides of a honeycomb structure. Heated air is applied to the transfer sheet to sublime the dyes in the ink and to transfer the sublimed dyes from the carrier, through the passageways of the honeycomb structure, to the carpet. The fibers of the carpet are thereby dyed.

10 Claims, 3 Drawing Figures

METHOD OF NO-CONTACT PRINTING OF CARPET WITH A TRANSFER SHEET

BACKGROUND OF THE INVENTION

1. Field of the Invention

The invention is primarily directed to a technique for the no-contact printing of carpet, and more particularly, to a no-contact printing technique that uses sublimable dyes on a transfer carrier and a spacer-transfer device between the transfer carrier and the carpet being printed to dye the fibers of the carpet.

2. Description of the Prior Art

U.S. Pat. No. 3,458,335 teaches a heat sensitive transfer sheet having an open screen layer thereon and the method of making this sheet. An open, fine screen layer having strips ranging in height from between 0.00001 inch and 0.01 inch and being uniformly spaced from each other by a distance in the range of between 0.00001 inch and no more than about 0.05 inch is provided over a coating of heat vaporizable or sublimable material on a transfer sheet. The open, fine screen layer is used to prevent the contact-migration of the vaporizable material on the transfer sheet when a copy sheet is placed in contact with the transfer sheet when no heat is being applied to the transfer sheet, and especially, when the transfer sheet is stored in contact with a copy sheet for a prolonged period of time.

The inventive technique herein uses a honeycomb structure with passageways therethrough as its spacer-transfer device to space the transfer sheet from the carpet being printed and to produce and maintain laminar flow of the sublimed dyes between the transfer sheet and the carpet being printed. The prior art teaches the use of the open, fine screen layer to prevent the transfer of sublimable material to a copy sheet when in contact with the copy sheet and prior to heating the sublimable material.

U.S. Pat. No. 2,984,540 teaches a method and apparatus for printing and dyeing pile carpeting. A large number of small, contiguous color receptacles formed by thin, upstanding rubber walls are formed on the surface of an endless belt. The individual color receptacles are filled to a desired level with a coloring agent or material. The pile of the carpet is pressed into the color receptacles as the carpet is pressed against the rotating endless belt having the color receptacles thereon. The pile is thereby dyed. The walls of the color receptacles prevent any lateral shift back squeezing of the coloring agent, resulting in an even, uniform coloring action and a perfect consistency and uniformity of fabric color regardless of the length of the run.

The inventive technique herein uses sublimable dyes for the printing, whereas this prior art teaches the use of a viscous coloring agent applied directly to the pile for the printing of the carpet. Also, the inventive technique herein does not require the use of any mechanical pressure to transfer the sublimable dyes to the carpet, whereas this prior art teaches the necessity of using such mechanical pressure. Lastly, the inventive technique herein uses any one of the passageways of the spacer-transfer device to transfer one or more colors therethrough from the transfer sheet to the carpet being printed, whereas this prior art teaches the use of transferring to the carpet from the color receptacle one color for any one color receptacle.

U.S. patent application Ser. No. 612,908, which has the same assignee as this application, teaches the printing of a carpet using sublimable dyes. A pattern is placed on a porous transfer sheet by the use of sublimable dyes. The side of the transfer paper printed with the sublimable dyes is placed adjacent the face yarns of the carpet. Heated air passing through the porous transfer sheet and the carpet causes the dyes to sublime and move from the transfer sheet to the face yarns of the carpet, thereby dyeing these face yarns.

This prior art application teaches that a sharp, well-defined image is formed on the face fiber yarns of the carpet when the transfer sheet contacts the yarns and that at about a ⅛ inch (0.3 cm) spacing between the transfer sheet and the face fiber yarns, a slight change in sharpness of image is noted and that at 1 inch (2.5 cm) spacing between the transfer sheet and the face fiber yarns, the printed image on the face fiber yarns is diffused. The applicants' invention teaches a method of transfer printing which uses a spacer-transfer device between the transfer sheet and the carpet being printed to achieve greater spacing therebetween than was possible with this prior art while still maintaining a sharp image transfer.

SUMMARY OF THE INVENTION

Inks containing sublimable dyes are printed onto a carrier and dried thereon. A carpet having conventional face fibers and a conventional backing is prepared. A spacer-transfer device with passageways therethrough is positioned between the carrier and the carpet with the inked surface of the carrier adjacent the openings of the passageways on one side of the spacer-transfer device and the face fibers of the carpet adjacent the openings of the passageways on the opposite side of the spacer-transfer device. The spacer-transfer device is used to space the transfer carrier from the carpet and to produce and maintain laminar flow therebetween. Hot air is then applied to the transfer carrier to sublime the dyes in the ink and to transfer the sublimed dyes from the carrier, through the passageways of the spacer-transfer device, to the carpet so that the fibers of the carpet are thereby dyed. The printed carpet is then separated from the transfer carrier and the spacer-transfer device.

An object of this invention is to achieve another way of transfer printing carpet using sublimable dyes. Another object of this invention is to transfer print carpet using sublimable dyes with a greater spacing between the transfer sheet and the carpet being printed than was heretofore taught by the prior art.

DESCRIPTION OF THE PREFERRED EMBODIMENT

Inks containing sublimable dyes are printed in any desired design onto a porour transfer material, e.g., glass fiber paper, cellulosic-glass fiber paper, cellulosic paper, jute, spun-bonded polyester, and other such porous materials, with a conventional printer, e.g., a rotary screen printer or any other commercially available printer capable of printing the desired design. The inks printed on the transfer sheet are then dried.

A carpet having face fibers and a backing is prepared. The carpet may be of conventional structure, e.g., tufted single or multilevel loop pile, tufted single level cut pile, tufted single or multilevel cut and loop pile, needle punched, and may have many different combinations of fibers and backings.

Figure 1:
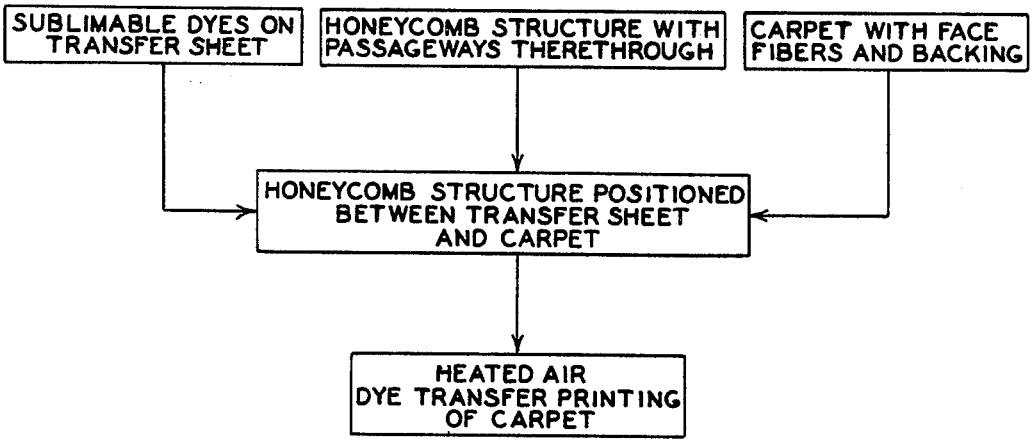
FIG. 1 is a schematic view of the method described herein, the legends on all figures being self-explanatory.
Figure 2:
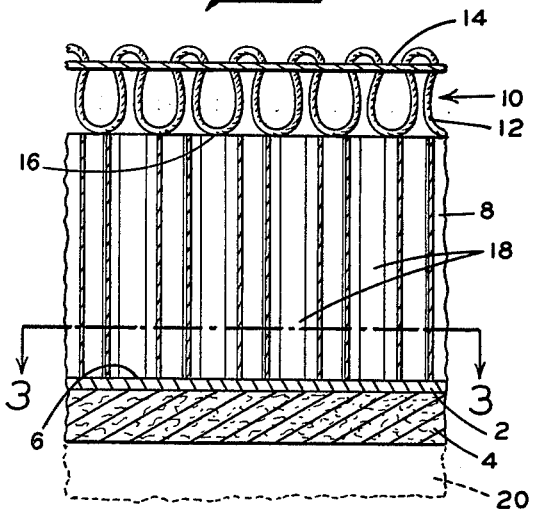
FIG. 2 is a cross-sectional view of a carpet arranged for printing according to the method of the present invention.

As shown in FIG. 2, the dried printed ink 2, which comprises a desired design on the porous transfer carrier 4, is positioned in contact with surface 6 of the honeycomb structure 8. The carpet 10 having face fiber yarn 12 tufted through backing 14 is positioned against the honeycomb structure 8 so that the face fiber yarn 12 is in contact with the surface 16, which is opposite surface 6, of the honeycomb structure 8.

The transfer sheet-honeycomb structure-carpet assembly is then subjected to a heated air treatment wherein heated air is passed through the porous transfer carrier, through the passages 18 of the honeycomb structure 8, through the carpet, and out the backing of the carpet. The heated air passing through the porous, printed transfer paper causes the sublimable dyes in the printed ink to sublime and to be transferred in their vapor state through the passageways 18 of the honeycomb structure 8 to the carpet 10, thereby dyeing the fibers 12 thereof.

Figure 3:
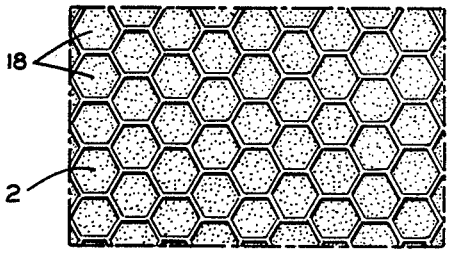
FIG. 3 is a cross-sectional view of the honeycomb structure of FIG. 2 taken along line 3.

FIG. 3 shows the cross-sectional view of the honeycomb structure 8. The cross section of each of the passageways 18 of the honeycomb structure 8 is hexagonal. The passageways 18 are designed so that their sides are parallel throughout their length between surfaces 6 and surfaces 16 and are perpendicular to said surfaces. These passageways, therefore, serve to produce and maintain a laminar flow of the hot air passing from the transfer sheet 4 to the carpet 10. It is this laminar flow which transfers the dye from the porous paper to the carpet being printed in the same desired design which was printed on the transfer paper. Although optimum conditions of laminar flow would have all the sides of passageways 18 parallel, the sides could be slightly off parallel and there would be no adverse effect on the image being printed on the carpet.

When a carpet being printed is positioned with its face fibers against the one surface of the honeycomb structure, the image transferred from the transfer sheet on the opposite side of the honeycomb structure to the carpet will always produce the same design on the carpet, but will be a mirror image of the design printed on the transfer sheet. If the carpet to be printed were positioned with its backing against the side of the honeycomb structure opposite the side contacting the transfer sheet, the carpet will always have the same design as the transfer sheet and it will not be a mirror image thereof.

After the carpet has been printed, the carpet is separated from the used transfer paper and the honeycomb structure. The used transfer paper may then be discarded.

Since it is the laminar flow between the transfer sheet and the carpet which produces a sharp image transfer from the sheet to the carpet, and since laminar flow is measured by the Reynolds number of the flow, it is necessary to maintain a laminar flow between the transfer sheet and the carpet being printed having a Reynolds number which is no greater than 2100. The Reynolds number, $N_{RE}$, is defined by the equation DVp/u where D equals the equivalent diameter of the passageway through which the fluid is flowing, V equals the velocity of the fluid flowing through the passageway, p equals the density of the fluid, and u equals the viscosity of the fluid. When using heated air as the transfer medium, the density and viscosity thereof are essentially fixed. Therefore, to vary the Reynolds number, the equivalent diameter of the passageways being used and the velocity of the medium being passed therethrough may be varied. So long as the equivalent diameter and velocity are not varied to give a number greater than 2100, laminar flow should be maintained in the passageway with a resultant sharp image transfer from the transfer paper to the carpet being printed.

Through experimentation, it has been determined that $\frac{3}{4}$ inch is the upper equivalent diameter limit at which a sharp image may be transferred from the transfer paper to the carpet being printed. The lower equivalent diameter limit of the passageways, which may be 1/32 inch, is determined by the practical limits of a passageway through which air can transport the sublimed dye. Besides the diameter limitations for producing laminar flow, it has been determined that the ratio of the length of the passageway to the largest equivalent diameter thereof should be at least about 5:1. Although a downward revision of this ratio is not limiting, the printed design transferred from the transfer sheet to the carpet becomes less sharp the more the ratio is decreased. An upward revision of this ratio should not detract from the laminar flow in the passageways so long as the practical limitations of the system, e.g., heat loss, smoothness of the walls of the passageways, do not interfere to cause the flow to become turbulent. The upward revision of this length-largest equivalent diameter ratio of the passageways with the new, just stated practical limitations should produce just about as sharp a transferred image as a 5:1 ratio where maximum clarity of image transfer takes place.

Although the spacer-transfer device has been described in this preferred embodiment as a honeycomb structure with passageways therethrough, i.e., hexagonal cross sections, this configuration is not a limiting factor for the transfer device. Many geometrical configurations can be stacked together to make a transfer device capable of producing and maintaining laminar flow so long as the sides of these configurations are basically parallel throughout the length of the passageway. By way of example only, the cross section of some geometric configurations which could be stacked together to comprise a transfer device could be circular, triangular, and square, to name but a few.

An example of a carpet printed using the above-described preferred embodiment of the invention is as follows: The transfer device between the transfer sheet and the carpet being printed is a honeycomb structure having passageways of an equivalent diameter of 0.25 inch and a length of 1.50 inches, the length-equivalent diameter ratio being 6:1. The face fiber yarns of the carpet contact the side of the honeycomb structure opposite the side contacting the dried ink of the transfer sheet. The porous glass fiber paper used as the transfer sheet is a non-woven material weighing 2.7 oz. per square yard (91.5 g per square meter) with an air permeability of 208 standard cubic feet per minute per square foot (63.4 standard cubic meters per minute per square meter). The carpet is constructed of 13 oz. per square yard (441 g per square meter) Nylon 6:6 Dupont Type 846 yarn (a 1300 denier, bulk continuous filament yarn) tufted into 6 oz. per square yard (203 g per square meter), 19 × 19 jute backing. The carpet is a single level, loop pile construction. The air flow is 78.3 standard cubic feet per minute per square foot (23.8 standard cubic meters per minute per square meter) for 0.3 minutes at a temperature of 425° F. (218.3° C.). The Reynolds number, $N_{RE}$, is approximately 117. The design transferred to the carpet is a duplicate of the design on the transfer paper, but a mirror image thereof. The design transferred to the carpet has a sharp and well-defined image.

A second example is as follows: The transfer device between the transfer sheet and the carpet being printed is a square structure having passageways of an equivalent diameter of 0.75 inch and a length of 2.0 inches, the length-equivalent diameter ratio being 2.7:1. The face fiber yarns of the carpet contact the side of the honeycomb structure opposite the side contacting the dried ink of the transfer sheet. The porous glass fiber paper used as the transfer sheet is a non-woven material weighing 2.7 oz. per square yard (91.5 g per square meter) with an air permeability of 208 standard cubic feet per minute per square foot (63.4 standard cubic meters per minute per square meter). The carpet is constructed of 13 oz. per square yard (441 g per square meter) Nylon 6:6 Dupont Type 846 yarn (a 1300 denier, bulk continuous filament yarn) tufted into 6 oz. per square yard (203 g per square meter), 19 × 19 jute backing. The carpet is a single level, loop pile construction. The air flow is 98.0 standard cubic feet per minute per square foot (29.9 standard cubic meters per minute per square meter) for 0.3 minutes at a temperature of 425° F. (218.3° C.). The Reynolds number, $N_{RE}$, is approximately 455. The design transferred to the carpet is a duplicate of the design on the transfer paper, but a mirror image thereof. The design transferred to the carpet has a satisfactory sharp and well-defined image, but relatively, it is not as sharp as the first example presented.

An alternative process for maintaining laminar flow when using the no-contact printing process of this invention would be to add an additional laminar flow producing and maintaining device in front of the transfer sheet. Such a laminar flow device is indicated by numeral 20 in FIG. 2. This device could be of identical structure to the honeycomb structure 8 or it could vary in diameter or length or cross section or any combination thereof to assist in producing and maintaining a laminar flow through the entire assemblage. The main purpose of positioning such a laminar flow producing and maintaining device between the source of heated air and the transfer sheet is to attempt to induce laminar flow into the system as soon as possible. One example where the use of a laminar flow device in front of the transfer paper assisted in producing a sharper image was where a ½ inch equivalent diameter honeycomb structure was used between the transfer sheet and the carpet to be printed. In this example, a ¼ inch equivalent diameter honeycomb structure was used between the heated air source and the transfer sheet. The length of the ½ inch equivalent diameter honeycomb structure was 2 inches, the length-equivalent diameter ratio being 4:1. The length of the ¼ inch equivalent diameter honeycomb structure was 1.50 inches, the length-equivalent diameter ratio being 6:1. The transfer sheet was porous glass fiber paper which is non-woven material weighing 2.7 oz. per square yard (91.5 g per square meter) with an air permeability of 208 standard cubic feet per minute per square foot (63.4 standard cubic meters per minute per square meter). The carpet is constructed of 13 oz. per square yard (441 g per square meter) Nylon 6:6 Dupont Type 846 yarn (a 1300 denier, bulk continuous filament yarn) tufted into 6 oz. per square yard (203 g per square meter) 19 × 19 jute backing. The carpet is a single level, loop pile construction. The air flow is 157 standard cubic feet per minute per square foot (47.9 standard cubic meters per minute per square meter) for 0.16 minutes at a temperature of 425° F. (218.3° C.). The Reynolds number, $N_{RE}$, is approximately 486. The design transferred to the carpet is a duplicate of the design on the transfer paper, although a mirror image thereof, and has a sharp and well-defined image.

This invention is not limited to those examples set forth above since it would be obvious to those skilled in the art that many different kinds of carpet constructions could be printed using the method of this invention. By way of example only, the backing scrim materials for various carpet constructions could also include jute, non-woven polypropylene, glass fiber, woven polypropylene, and woven and non-woven polyester. Also by way of example only, the carpet facing materials for various carpet constructions could also include nylon, e.g., Nylon 6:6, Nylon 6, acrylic, and polyester fibers. The fibers could be in yarn form for tufting into the backing scrim or in non-woven form for needle punching into the backing scrim. Knitted goods could also be printed using the process of this invention.

The invention has been carried out with an air flow rate of as low as 15 standard cubic feet per minute per square foot (4.6 standard cubic meters per minute per square meter) and as high as 157 standard cubic feet per minute per square foot (48 standard cubic meters per minute per square meter). It would appear that the air flow upper limit is determined by the output capability of the air moving means and the Reynolds number, $N_{RE}$. The air flow rate is selected based upon the scrim material used, the face fiber used, the dye used, the operating temperature, the length and equivalent diameter of the laminar flow device used, and the desired production speed. Naturally, the porosity of the transfer sheet also influences, to some extent, the air flow.

The invention need not be restricted to just the use of heated air to cause the sublimable dyes to transfer, but the invention can also be carried out through the use of superheated steam. Other gases could be utilized, and it would appear that the three primary purposes of the gas utilized are (1) to cause the dye to change to a vapor phase, i.e., sublime; (2) to move the vapor phase dye from the transfer sheet through the laminar flow producing and maintaining structure, and to and through the carpet; and (3) to facilitate diffusion of the dye into the fiber of the carpet.

Successful transfer printing has been carried out with temperatures from 375° to 450° F. (191° to 232° C.) for the heated air. This has required printing times of from 5 to 0.16 minutes, respectively. The temperature used is a function of the scrim material, the face fiber, the length of the laminar flow producing and maintaining structure, and the dye being utilized.

The sublimable dyes used are primarily disperse dyes. Although these dyes have not been described in this application, a rather complete description and representation of dyes capable of being used are set forth in U.S. patent application Ser. No. 612,908, which is an application owned by a common assignee. Also, a description of the printing ink and how the printing ink is prepared is set forth in the same U.S. patent application Ser. No. 612,908.

What is claimed is:

1. A method of dye-transfer printing carpet using sublimable dyes comprising the steps of:

(a) printing an ink containing sublimable dyes onto a porous carrier;

(b) preparing a carpet having fibers and a backing;

(c) arranging said carrier and said carpet in a spaced apart relationship with the inked surface of said carrier facing said carpet;

(d) positioning fluid flow means comprising a plurality of juxtaposed adjoining elongated cylindrical passageways of polygonal cross section for producing and maintaining laminar flow between said carrier and said carpet wherein the equivalent diameter of said passageways is in the range of from about 1/32 inch to about ¾ inch;

(e) applying a heated gaseous medium to said carrier by passing said medium through said carrier to sublime the dyes in the ink and to transfer the sublimed dyes from the carrier, through said fluid flow means, to the carpet so that the fibers of the carpet are dyed; and (f) separating the printed carpet from said carrier and said fluid flow means.

2. The method of claim 1 wherein said fluid flow means produces and maintains laminar flow having a Reynolds number no greater than 2100.

3. The method of claim 1 wherein said polygonal cross section is hexagonal.

4. The method of claim 1 wherein the porous carrier is glass fiber transfer paper.

5. The method of claim 1 wherein the heated gaseous medium is heated air.

6. The method of claim 1 wherein said carrier and said carpet are of sufficient porosity to permit the passage of said medium through the said carrier, said fluid flow means, and said carpet in the range of from about 15 standard cubic feet per minute per square foot to about 157 standard cubic feet per minute per square foot.

7. The method of claim 6 wherein said medium is supplied at a temperature in the range of from about 375° to about 450° F. and the dye transfer time ranges from about 5 minutes to about 10 seconds.

8. The method of claim 1 comprising the additional step of positioning fluid flow means for producing and maintaining laminar flow adjacent the uninked surface of said carrier to produce and maintain laminar flow of said medium to said carrier.

9. The method of claim 8 wherein the fluid flow means positioned adjacent the uninked surface of said carrier comprises a plurality of juxtaposed adjoining elongated cylindrical passageways of polygonal cross section.

10. The method of claim 9 wherein the polygonal cross section of said passageways of said fluid flow means positioned adjacent the uninked surface of said carrier is hexagonal.

* * * * *